US006679858B2

(12) United States Patent
Ray

(10) Patent No.: US 6,679,858 B2
(45) Date of Patent: Jan. 20, 2004

(54) DEVICE TO ASSIST IN RELAXATION AND RELIEF OF THE STRESS OF A SUBJECT

(76) Inventor: Johnney Ray, 2 Crystal Dr., Washingtonville, NY (US) 10992

( * ) Notice: Subject to any disclaimer, the term of this patent is extended or adjusted under 35 U.S.C. 154(b) by 0 days.

(21) Appl. No.: 10/234,268

(22) Filed: Sep. 4, 2002

(65) Prior Publication Data

US 2002/0198477 A1 Dec. 26, 2002

Related U.S. Application Data

(63) Continuation-in-part of application No. 09/757,234, filed on Jan. 9, 2001, now abandoned.

(51) Int. Cl.[7] ..... A61H 7/00; A61H 11/00

(52) U.S. Cl. ..... 601/95; 601/101; 601/117; 601/136

(58) Field of Search ..... 601/46, 84, 89, 601/90, 93, 95, 97, 98, 101, 103, 108, 111, 115, 117, 136

(56) References Cited

U.S. PATENT DOCUMENTS

| | | | | | |
|---|---|---|---|---|---|
| 2,143,320 | A | * | 1/1939 | Jones | 601/112 |
| 3,672,357 | A | | 6/1972 | Ferguson | 128/49 |
| 3,799,155 | A | * | 3/1974 | Gerlich | 601/103 |
| 4,228,794 | A | | 10/1980 | Boller | 128/49 |
| 4,312,333 | A | * | 1/1982 | Dreybus | 601/95 |
| 4,872,422 | A | | 10/1989 | Della Vecchia | 119/83 |
| 4,984,568 | A | | 1/1991 | Persaud | 128/51 |
| 5,016,617 | A | | 5/1991 | Tarlow et al. | 128/52 |
| 5,582,582 | A | | 12/1996 | Chapman | 601/112 |
| 5,916,182 | A | * | 6/1999 | Fengler | 601/110 |
| 6,074,353 | A | | 6/2000 | Helmer | 601/136 |
| 6,283,929 | B1 | * | 9/2001 | Mjehovic | 601/136 |

* cited by examiner

*Primary Examiner*—Nicholas D. Lucchesi
*Assistant Examiner*—Quang D Thanh
(74) *Attorney, Agent, or Firm*—Sandra M. Kotin

(57) ABSTRACT

The invention is a device used for relaxation and for the relief of stress. The device is placed next to a bed on which the subject lies prone. It may be situated on the floor or on a bed side table. An adjustable vertical support column mounted on a base supports a rotatably mounted motor cooperating with a horizontally oriented sweep arm. The sweep arm is equipped with depending "fingers" that make constant contact with the subject's back when the height of the support column is properly adjusted. Different types of "fingers" can be reversibly attached to the sweep arm. The sweep arm moves in a back and forth motion controlled by the rotating motor. A timer enables the device to be turned off automatically so as not to disturb the relaxation of the subject.

6 Claims, 4 Drawing Sheets

FIG.1
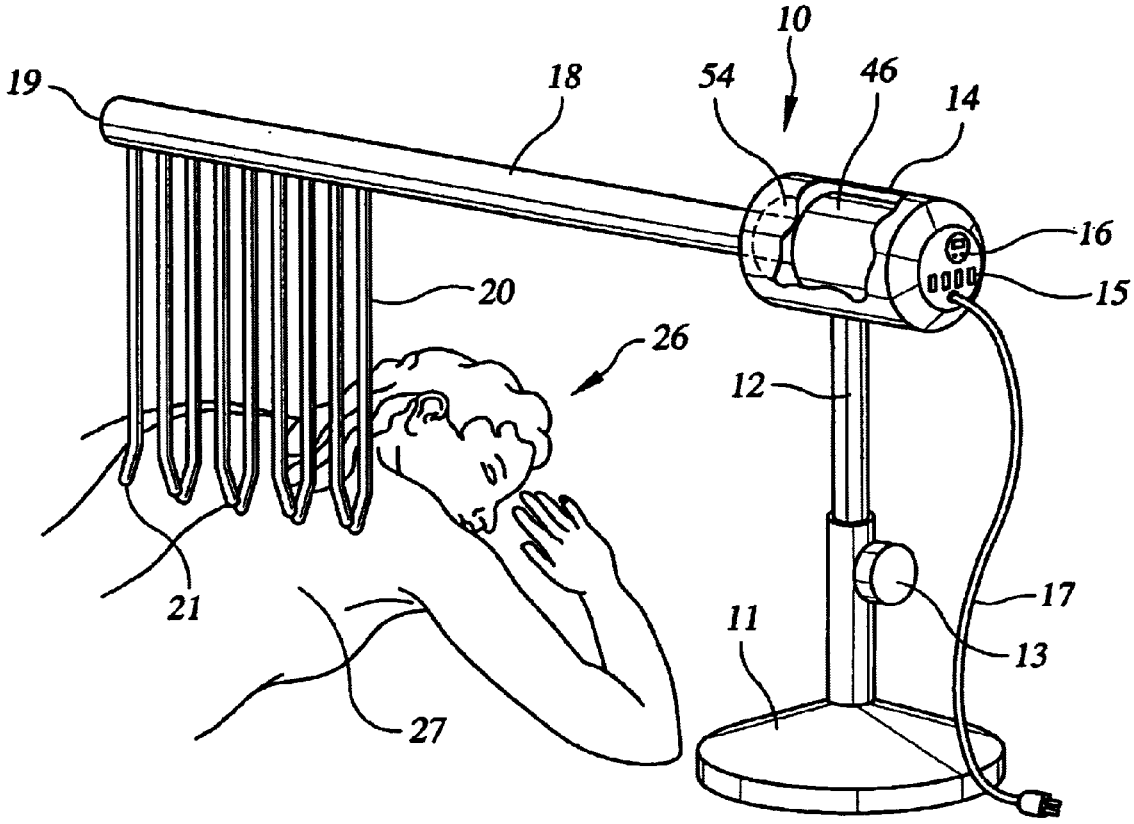
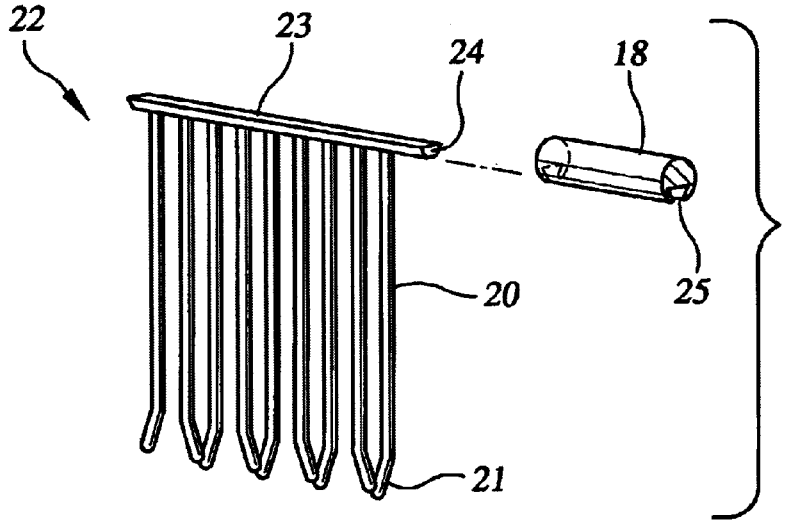
FIG.2

DEVICE TO ASSIST IN RELAXATION AND RELIEF OF THE STRESS OF A SUBJECT

CONTINUATION-IN-PART

This application is a continuation-in-part of my U.S. application Ser. No. 09/757,234 entitled "Device to Assist in Relaxing and Relieving the Stress of a Subject" filed on Jan. 9, 2001, now abandoned.

FIELD OF THE INVENTION

The instant invention relates to a device which provides continuous gentle moving contact with the human body for the purpose of relieving stress and enhancing relaxation.

BACKGROUND OF THE INVENTION

There are a variety of devices used to message the human body and which provide many different modes of body contact. These devices exhibit a wide range in the amount of force or pressure that is exerted on the body so that a user may experience sensations ranging from a true message to a light caress. Many of the devices provide intermittent contact, some involve large and cumbersome framework and others provide a small contact head that makes minimal contact with the body.

Ferguson, in U.S. Pat. No. 3,672,357, teaches a massage apparatus consisting of a rectangular frame positioned over a bed and supporting a carrier that moves in a prescribed repetitive path along a track. The carrier holds a massage applicator which makes contact with the body of a person lying prone on the bed. In one embodiment a motor drives a threaded rod in contact with the carrier causing the carrier to move back and forth over the body. The massage applicator is in the form of dangling cords which may have different degrees of stiffness. The applicator sweeps across the entire length of the body and since the body has many contours there is intermittent contact and varying pressure. Several embodiments are described, all of which require another person to turn the device on and off since the subject is lying under the frame. The subject would have to crawl under the frame or have someone lift the frame so he can lie down within the massaging area and lift it again when he chooses to rise.

U.S. Pat. No. 4,228,794 to Boller discloses a hand held massager requiring that one person, the user, hold the device and give the massage to another person, the subject. The device has a series of protruding fingers that alternately make contact with the back of the subject This device is air cooled so the user can hold it for prolonged periods. The user can vary the pressure or degree of massage as desired. Only a small part of the body of the subject is contacted at any time and this device is not designed to provide a light or soothing touch.

A scratching and petting device for household pets is taught by Della Vecchia in U.S. Pat. No. 4,872,422. A wall mounted vertical base has a foldable horizontally extending petting arm that can be adjusted to different heights according to the size of the animal. The petting arm is biased for an up and down movement. It is suspended at a point about one third of its length from the vertical base by one end of a flexible cable or cord with the other end of the flexible cable being tied to a bracket on the vertical base. The flexible cord permits the up and down motion of the petting arm which is initiated when an electric eye is activated by the close proximity of the animal. The animal learns to position itself so that the stiff hand-like portion at the end of the arm moves vertically as it contacts the head or back of the animal, depending on the height at which the arm is set. This device has only a finger sized contact with the animal's body and would not be very soothing if used by a human. A human would have to move around to have a device such as this scratch different parts of his body and this would not be very relaxing. When not in use the petting arm can be moved to a rest position by manually removing the cord and allowing the petting arm to pivot to a downward position along the vertical base.

Persaud teaches another type of back massager in U.S. Pat. No. 4,984,568. This device is clamped to the side rail of a bed and is for massaging an individual's back. A vertical rod is equipped with a hydraulic assembly so it can be raised or lowered. A horizontal arm, also with a hydraulic assembly, can move a massage head vertically and angularly about the back of the subject. The massage head can be fitted with rollers or resilient fingers. A control box is used to program the path of the massage head and also has a timer to set the duration of use. The head can also be used to dispense lotion. The subject may also cause the head to move and to dispense lotion by means of a joy stick. The need to constantly move the massage head with the joy stick removes any pleasure of just relaxing. This device is specifically for providing a message, and is not designed for a light touch. The subject must also be positioned just under the massage head for best results.

An automatic body massaging device is taught by Tarlow et al. in U.S. Pat. No. 5,016,617. The small base of the device fits between the mattress and box spring of a conventional bed. A vertical column attached to the base supports a substantially oval track. A roller moves around the track and carries a leather piece cut into strips. The strips have hook and loop type fasteners at their ends to which various weights may be attached. The weighted strips provide the massage.

A battery powered motor moves the roller around the track. As the roller moves around the track the strips alternately make contact and lose contact with the back of the subject. Unless the device is disconnected from the bed the track is always positioned directly over the sleeping surface causing the subject to duck under the track to lie down and to be careful not to hit the track when rising. Depending upon the position of the roller when the device is turned off, the strips may remain directly over the bed and in contact with the subject whenever the subject is on the bed. The subject must turn the device on before lying down and rise to turn it off or have another person present for assistance.

A back massaging apparatus that rests on a bed or massage table is disclosed by Chapman in U.S. Pat. No. 5,582,582. A rectangular frame is supported on the table by means of four telescoping legs. A cross rail moves back and forth along the side rails of the frame by means of a motor which drives a chain loop positioned over each side rail. The cross rail carries a massaging unit containing four rotatable heads each having downwardly extending fingers which may be rigid or soft. A second motor turns the heads and moves the unit back and forth over the cross rail. This massager must be positioned over the subject once he is lying on the table, so there is a need for another person for assistance. The unit appears to require a fairly rigid flat surface and a bed may not offer sufficient support thus making a special massage table a necessity. The spring activated up and down motion of the massage fingers provides a substantially forceful massage and will not give the light touch required for relaxation or sleep induction.

The device would have to be lifted away from the table before the subject could rise.

In U.S. Pat. No. 6,074,353 Helmer discloses a device designed to caress or tickle the body. A floor stand or base of the device rests on the floor. A vertical axle is supported by the floor stand which has a central channel into which the vertical axle is situated and in which it is permitted to rotate. A horizontal support rod is attached to the vertical axle by means of a clamping device and is rotated with the vertical axle. The vertical axle rotates by communication with a co-axial gear which is rotated by means of a stationary motor, a gear and a belt. The motor can rotate the gear assembly clockwise or counterclockwise. Strips of a soft flexible material such as feathers, cloth or rope are attached to the horizontal support rod and move in a circular path as the vertical axle rotates. The height of the horizontal support rod can be adjusted along the vertical axle by adjusting the clamping device, but the vertical axle is of fixed length. A control box enables the subject to change the speed and direction of rotation and to stop and start the motor. As the horizontal support rod moves in its circular path the strips of material alternately are in contact with and are out of contact with the back of the subject. The subject has to control the device and must press the stop button to turn it off.

Most of the prior art devices require the assistance of another person in using the device because they must be placed near or over the subject while the subject lies prone and the devices must be turned on and off manually. If the subject has to activate and deactivate the device himself it is impossible for the subject to relax completely or to fall asleep while the device is in use. Many of the devices use soft flexible strips of material. Other prior art devices have massage arms or elements that move in such a manner that they alternately move off and on to the back of the subject interrupting any soothing sensation the device may provide. The prior art devices that are attached to or rest on the bed during use must be removed to some other location in order to use the bed for sleeping. Some of the prior art devices have heavy clumsy frames that must be set on the bed and then removed. These devices are quite large and require considerable storage area.

There is a need for an automatic relaxation inducing device that can be utilized by the subject alone. There is a need for an automatic relaxation device that maintains constant contact with the body of the subject for maximum relaxation. There is a need for a device that enables the subject to fall asleep during use by automatically shutting off after a pre-set time period. There is a need for a relaxation device that can be placed in close proximity to a bed such that most of the base lies under the bed and out of the way and where the base is sufficiently stable to support the device when not in use.

BRIEF SUMMARY OF THE INVENTION

It is an object of the present invention to provide a device that will assist the subject to relax and will relieve stress.

It is an object of the present invention to provide a device that can mimic the feeling of having one's back gently stroked by a companion.

Another object of the present invention is to provide constant contact with the subject's back during the period of use.

A further object of the present invention is to have a device that can provide more than one contact means.

Another object of the present invention is to have a device in which more than one contact means can be used at the same time.

A still further object of the present invention is to have a device which enables the user to select and easily change the contact means.

Another object of the present invention is to have a device that has a timer so the user can relax and fall asleep and the device will automatically shut off after a preset time period.

A further object of the present invention is to have a device with a stable base that can be placed under the bed and out of the way.

The invention is a relaxation inducing device of a type designed to be used by a subject lying prone on a raised horizontal surface. The device comprises a base capable of placement substantially under the raised horizontal surface; a vertical support column having an upper end and a lower end and being affixed at the lower end to an exposed portion of said base such that said support column is situated adjacent to the raised horizontal surface; a motor rotatably mounted at the upper end of the support column; means to rotate the motor; a sweep arm having a proximal end and a distal end and being in cooperation with the motor at the proximal end such that the sweep arm is oriented horizontally outward from said motor and is moved back and forth over the subject as the motor rotates; at least one contact member depending from the distal end of the sweep arm, said contact member being composed of a semi-rigid material; and adjustment means integral with said vertical support column to adjust the height of said vertical support column such that the contact member makes contact with the subject when the sweep arm moves back and forth.

A relaxation inducing device of a type designed to be placed adjacent to a horizontal surface on which a subject lies prone comprises a base; a vertical support column having an upper end and a lower end and being affixed to said base at the lower end; a motor rotatably mounted at the upper end of the support column; means to rotate the motor; a sweep arm having a proximal end and a distal end and being in cooperation with said motor at the proximal end such that the sweep arm is oriented horizontally outward from said motor and is moved back and forth over the subject as the motor rotates; at least one contact member depending from the distal end of the sweep arm, said contact member being composed of a semi-rigid material; and adjustment means integral with vertical support column to adjust the height of the vertical support column such that the contact member remains in contact with the subject when the sweep arm moves back and forth.

A relaxation inducing device of a type designed to be placed adjacent to a horizontal surface on which a subject lies prone, wherein the device comprises a base; a vertical support column having an upper end and a lower end and being affixed to said base at the lower end; a motor rotatably mounted at the upper end of the support column; means to rotate the motor; a sweep arm having a proximal end and a distal end and being in cooperation with said motor at the proximal end such that the sweep arm is oriented horizontally outward from said motor and is moved back and forth over the subject as the motor rotates; at least one contact member depending from the distal end of the sweep arm, said contact member being composed of a semi-rigid material; adjustment means integral with said, vertical support column to adjust the height of said vertical support column so that the contact member remains in contact with the subject when the sweep arm moves back and forth; and a timer to preset the desired time period during which the motor is to be rotated.

A relaxation inducing device of a type designed to be placed adjacent to a horizontal surface on which a subject lies prone comprises a base; a vertical support column having an upper end and a lower end and being affixed to said base at the lower end; a motor rotatably mounted at the upper end of the support column; means to rotate the motor; a sweep arm having a proximal end and a distal end and being in cooperation with the motor at the proximal end such that the sweep arm is oriented horizontally outward from said motor and is moved back and forth over the subject as the motor rotates; at least one contact member depending from the distal end of the sweep arm, said contact member being composed of a semi-rigid material; adjustment means integral with said vertical support column to adjust the height of said vertical support column so that the contact member remains in contact with the subject when the sweep arm moves back and forth; a timer to preset the desired time period for which the motor is to be rotated; a housing rotatably mounted at the top of the support column for containment of the motor; and an aperture in said housing through which the sweep arm projects outwardly and horizontally.

A relaxation inducing device of a type designed to be placed adjacent to a horizontal surface on which a subject lies prone is disclosed. The device comprises a base; a vertical support column having an upper end and a lower end and being affixed to said base at the lower end; a motor rotatably mounted at the upper end of the support column; means to rotate the motor; a sweep arm having a proximal end and a distal end and being in cooperation with said motor at the proximal end such that the sweep arm is oriented horizontally outward from said motor and is moved back and forth over the subject as the motor rotates; at least one first contact member removably attached to the distal end of the sweep arm and depending therefrom, said first contact member being composed of a semi-rigid material; adjustment means integral with the vertical support column to adjust the height of said support column so that the first contact member remains in contact with the subject when the sweep arm moves back and forth; and at least one second contact member capable of being removably attached to the distal end of said sweep arm and depending therefrom, said second contact member being composed of a semi-rigid material and being capable of providing a sensation different from that of said first contact member when in contact with the subject.

A relaxation inducing device of a type designed to be used by a subject lying prone on a raised horizontal surface comprises a base capable of placement substantially under the raised horizontal surface; a vertical support column having an upper end and a lower end and being affixed at the lower end to an exposed portion of said base such that said support column is situated adjacent to the raised horizontal surface; a motor rotatably mounted at the upper end of the support column; means to rotate the motor; a sweep arm having a proximal end and a distal end and being in cooperation with the motor at the proximal end such that the sweep arm is oriented horizontally outward from said motor and is moved back and forth over the subject as the motor rotates; at least one first contact member removably attached to the distal end of the sweep arm and depending therefrom, said first contact member being composed of a semi-rigid material; adjustment means integral with said vertical support column to adjust the height of the vertical support column so that the first contact member remains in contact with the subject when the sweep arm moves back and forth; and at least one second contact member capable of being removably attached to the distal end of said sweep arm and depending therefrom, said second contact member being composed of a semi-rigid material and being capable of providing a sensation different from said first contact member when in contact with the subject.

Other features and advantages of the invention will be seen from the following description and drawings wherein similar reference characters are used to designate corresponding parts in all of the views.

BRIEF DESCRIPTION OF THE DRAWING

FIG. 1 is a perspective view of the device of the instant invention in use with a subject;

FIG. 2 is close-up perspective view of the contact unit and slotted sweep arm;

DETAILED DESCRIPTION OF THE INVENTION

The device 10 of the instant invention is shown in FIG. 1. It may be placed on any stable horizontal planar surface such as a bed-side table or floor so that the subject may utilize the device 10 while lying prone on a bed or massage table (not shown). The device 10 may be supported by a base 11 and a height-adjustable vertical support column 12. Such height adjustable supports are well known in the art. One type of height adjustable support may have nested cylindrical segments and an adjustment knob 13 so that the exact desired height may be easily attained. The base 11 may be sufficiently sized and weighted such that the device may be quite stable whether placed adjacent to a bed or free standing.

Figure 9:
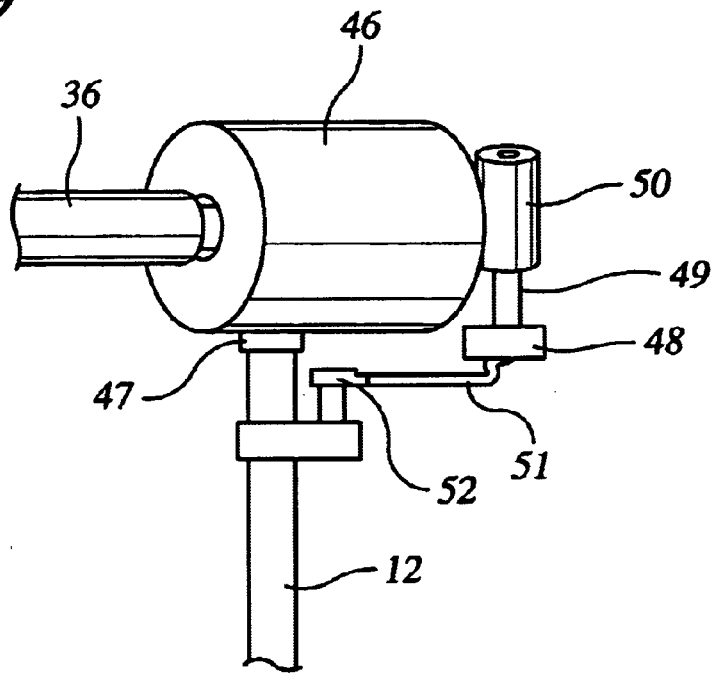
FIG. 9 is a perspective view of the motor and rotation means.

A motor 46 may be rotatably mounted at a pivot point 47 situated at the top of the vertical support column 12. The there may be a cam 48 that may be revolved by a gear assembly 50 and drive shaft 49 activated by the motor 46. A follower 51 may communicate between the cam 48 and a pivot 52 affixed to the vertical support column 12. Activation of the motor 46 may cause the cam 48 to revolve and the follower 51 to move with it causing the motor 46 itself to rotate in a back and forth motion. The shape of the follower 51 may determine the degree of rotation of the motor 46. See FIG. 9.

The motor 46 may be contained within a housing 14 that may rotate with the motor 46. There may be ventilation openings 15 in the housing 14 to assist in the venting of any heat that may be generated by the motor 46. One or more control switches 16 may be mounted on the exterior of the housing 14 to activate and deactivate the device 10. An electric cord 17 may depend from the housing 14 when an electric motor is used, but a battery powered motor may also be utilized.

A sweep arm 18 may be connected at its proximal end to the motor 46 so that it sweeps back and forth as the motor 46 rotates. The sweep arm 18 may pass through an opening 54 in the housing 14 and extend horizontally and outwardly from the motor 46 and the housing 14 for a considerable distance. There may be a series of contact members 20 depending from the distal end 19 of the sweep arm 18. The height of the vertical support column 12 may be adjusted so the contact members 20 make full and continuous contact with the back 27 of the subject 26 when the vertical support column 12 is placed adjacent to the bed and the subject lies prone thereon.

The contact members 20 may be semi-rigid but pliable so as to feel like another person is moving his or her fingers and/or fingernails back and forth over the subject's back 27. There are many polymeric substances, such as a variety of plastics known in the art, that may be used for this purpose. Lighter and more flexible materials may also be used, but such materials may provide a different sensation.

The contact members 20 may be affixed to the sweep arm 18 in more than one manner. One such manner may be to utilize a contact unit 22 as seen in FIG. 2. The contact members 20 may be permanently affixed to a rod 23 which is shaped for reversible retention within a similarly shaped slot 25 in the sweep arm 18. The rod 23 in cross section, and the slot 25 may be in the shape of an inverted trapezoid 24. The rod 23 may slide into the slot 25 to be held there securely, but may also be easily removed and another contact unit inserted. This structure may enable one contact unit 22 to be easily exchanged for another contact unit 28 that may have contact members 29 of another shape or size and which may provide a different sensation when moved across the body. See FIG. 6. The use of a semi-rigid polymeric material may enable the contact members to be made in a variety of shapes and angles.

Figure 8:
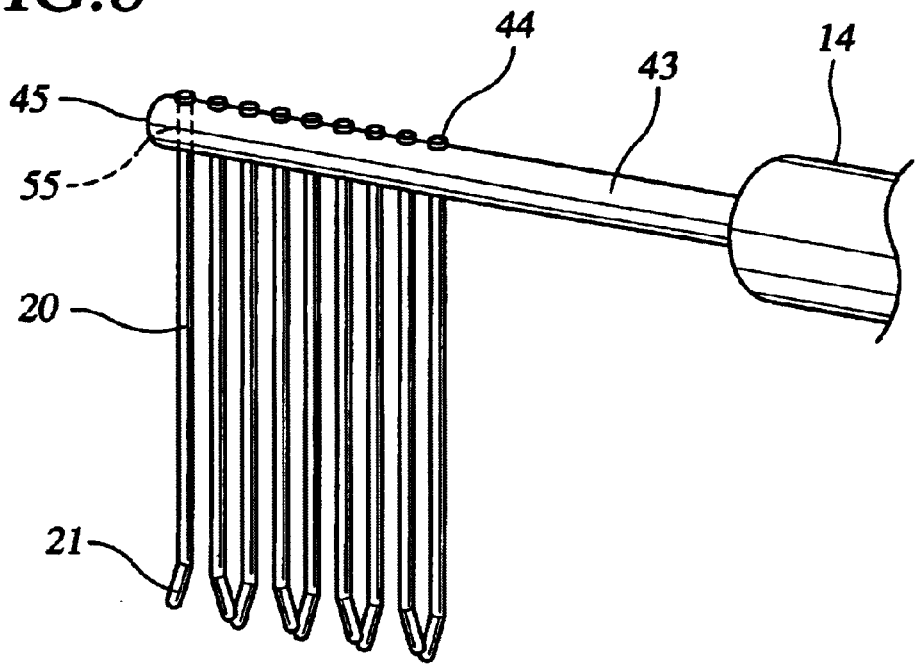
FIG. 8 is a perspective view of an alternative sweep arm.

In an alternate manner the contact members 20 may be permanently affixed to a different form of sweep arm 43 as seen in FIG. 8. Individual contact members 20 may be threaded through channels 55 in the distal end 45 of the sweep arm 43 and may be held in place by fasteners 44. When this form of sweep arm 43 is used, more than one type of contact member may be individually threaded and fastened along the distal end 45 of the sweep arm 43, or all of the contact members may be the same. The contact members may be selected and exchanged as per the wishes of the subject, or the entire sweep arm 43 with contact members 20 attached may be removable from the motor 46 and exchanged for another sweep arm with different contact members.

Figure 6:
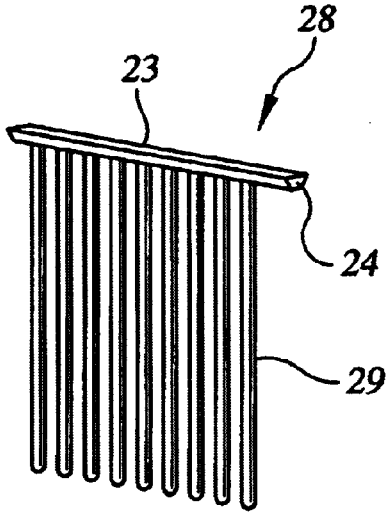
FIG. 6 is a perspective view of an alternative contact unit.

The contact members 20 may have bends at their ends 21 like fingernails as seen in FIGS. 1 and 2, which may better simulate the feeling of fingernails stroking the back of the subject, or the contact members 29 may be straight, as seen in FIG. 6, which may provide a slightly different sensation during use. As noted above, other shapes and angles may be possible.

Figure 3:
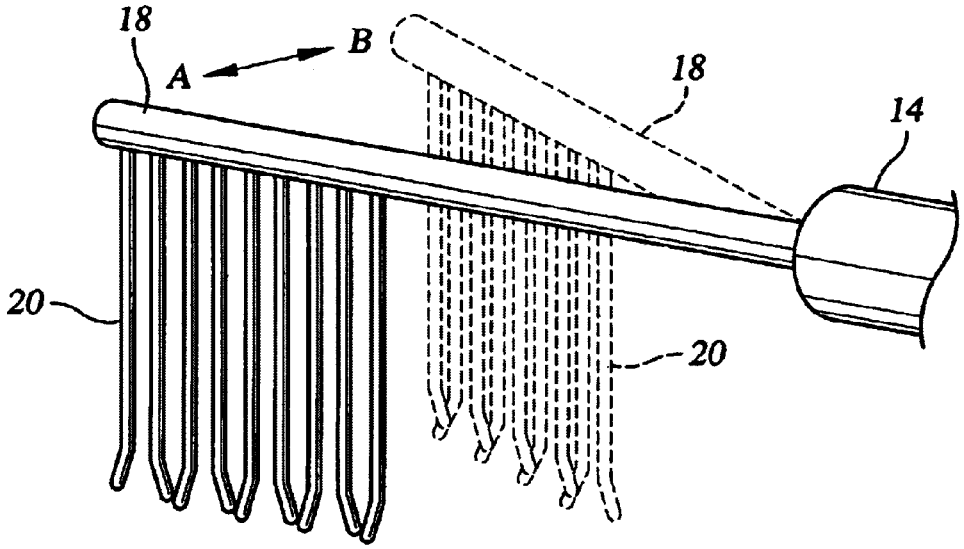
FIG. 3 is a perspective view of the sweep arm and contact unit showing the sweeping mode of motion.
Figure 4:
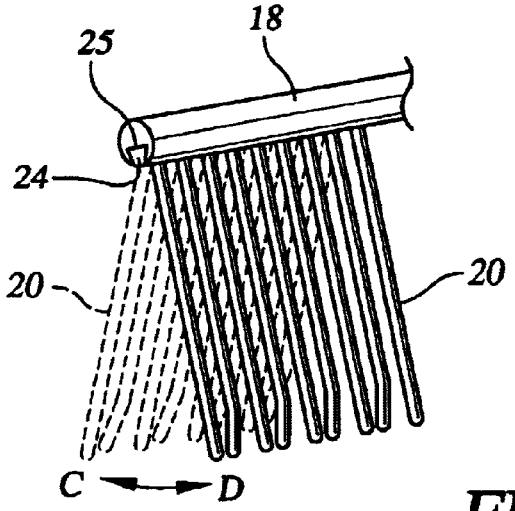
FIG. 4 is a perspective view of the contact unit showing an oscillating mode of motion.
Figure 5:
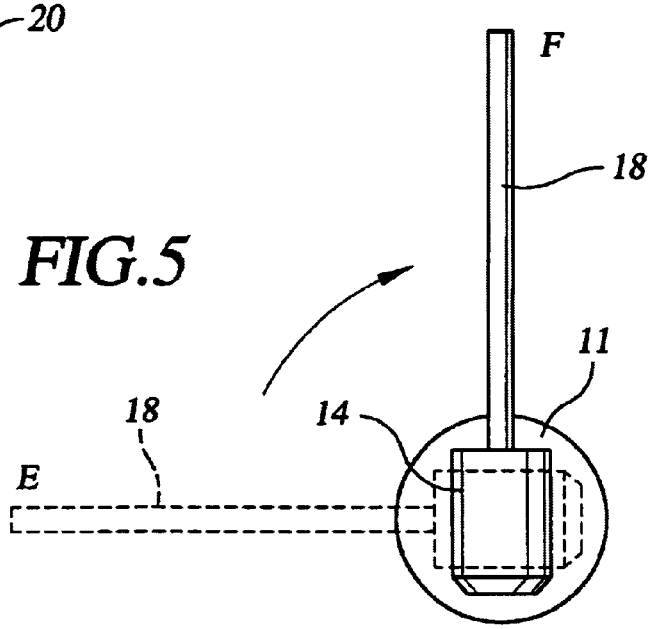
FIG. 5 is a top plan view of the device showing a wide sweep angle.

When the device 10 is activated the sweep arm 18 may be caused to sweep back and forth, by means of the cam 48 and follower 51, through an arc A–B, seen in FIG. 3. Arc A–B may be from 30° to 50° to insure that the contact members 20 may be in constant contact with the back 27 of the subject 26, but a wider angle may also be utilized as noted in FIG. 5. The starting position F of the sweep arm 18 may be seen in solid lines and the outer position E of the sweep arm 18 may be seen in dotted lines. While the sweep arm 18 is moving back and forth the contact members 20 may simultaneously be made to oscillate through an arc C–D seen in FIG. 4 by means of an oscillator (not illustrated) also associated with and activated by the motor 46. The subject 26 may elect to utilize only the sweeping mode (FIG. 3), or both the sweeping mode and the oscillating mode (FIG. 4) at the same time. Each selection may provide different sensations on the back 27 of the subject 26.

Figure 7:
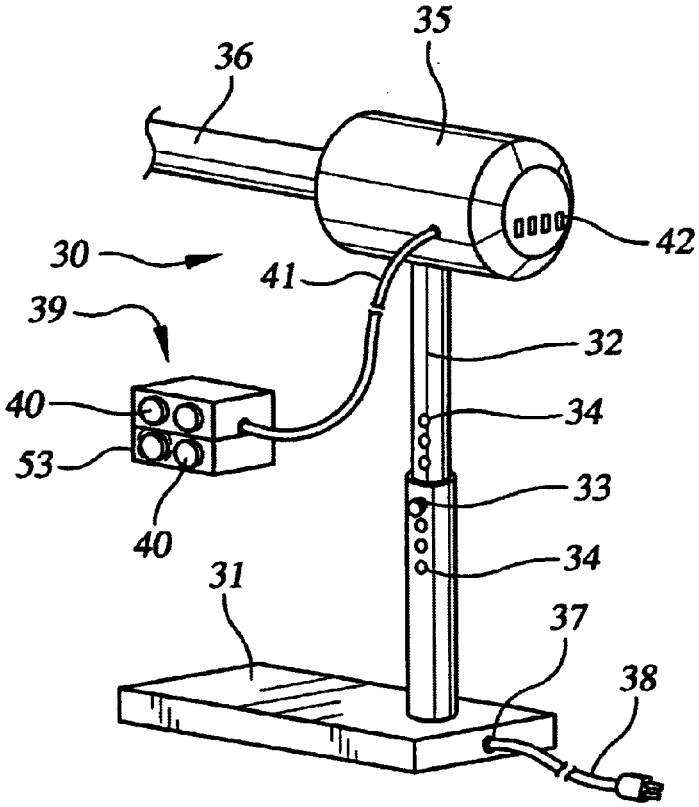
FIG. 7 is a perspective view of a second embodiment of the device of the instant invention.

A second embodiment 30 of the device may be is seen in FIG. 7. A housing 35 may be rotatably supported atop an alternate type of height-adjustable vertical support column 32 communicating with a somewhat different base 31. In this embodiment, the vertical support column 32 and the base 31 may form an L-shape that may enable the base 31 to be positioned entirely under a bed (not shown). This form of base may be out of the way and not take up floor space near the bed, yet it may still provide ample support and stability for the device when in use or when stored away from the bed. The vertical support column 32 may be composed of nested cylindrical segments that may be adjusted by means of spring activated buttons 33 that may extend through cooperating openings 34. An electric cord 38 may extend through an opening 37 at the bottom of the vertical support column 32. Methods are well known in the art to have an electric cord pass through an adjustable column. There may be a second cord 41 extending from the housing 35 to a control box 39. A timer 53 may be contained within the control box 39 so that the device 10 may be activated for specific periods of time and may thereafter shut off automatically. Such timers are well known in the art. The cord 37 may be long enough so that the control box 39 may be disposed on the bed so the subject 27 may be able to turn on the device 30, set the timer 53, and select the desired mode of motion. He or she may also change any of the settings without having to change position or rise from the bed. The control box 39 may contain all necessary dials or buttons 40 to accomplish the desired settings. In the alternative, the selections may be made using a similar control box that may utilize remote control means (not shown) and may negate the need for the second cord 41. There may be ventilation openings 42 in the housing 35 to assist in venting any heat that may be generated by the motor (not shown) within the housing 35.

To utilize the second embodiment 30 the subject may position the base 31 under the bed, make any necessary height adjustments, take his or her place on the bed and, with the control box 39 at hand, set the timer and desired mode of motion of the sweep arm 36 and just relax. When the selected time period is concluded the timer 53 may automatically cause the device to be turned off. If the subject does not fall asleep he or she may change the settings at any time. If the controls are affixed to the housing 14 as illustrated in FIG. 1 in the first embodiment 10, the selections may be made before the subject lies down on the bed. All of the settings may still be made by the subject 26 without the need for the assistance of a second person. Both embodiments 10 and 30 may be quite portable, easily moved from place to place, and just as easily placed against a bed for maximum contact with a prone subject.

While two embodiments of the present invention have been illustrated and described in detail, it is to be understood that this invention is not limited thereto and may be otherwise practiced within the scope of the following claims.

I claim:

1. A relaxation inducing device of a type designed to be used by a subject lying prone on a raised horizontal surface, said device comprising:

a base capable of placement substantially under the raised horizontal surface;

a vertical support column having an upper end and a lower end and being affixed at the lower end to an exposed portion of said base such that said support column is situated adjacent to the raised horizontal surface;

a motor rotatably mounted at the upper end of the support column;

means to rotate the motor;

a sweep arm having a proximal end and a distal end and being in cooperation with the motor at the proximal end such that the sweep arm is oriented horizontally outward from said motor and is moved back and forth over the subject as the motor rotates;

at least one contact member depending from the distal end of the sweep arm, said contact member being composed of a semi-rigid material; and adjustment means integral with said vertical support column to adjust the height of said vertical support column such that the contact member makes contact with the subject when the sweep arm moves back and forth;

whereby when the motor rotates, the sweep arm rotates with it, and the contact member makes contact with the subject and moves back and forth across the subject thereby inducing relaxation.

2. A relaxation inducing device of a type designed to be placed adjacent to a horizontal surface on which a subject lies prone, said device comprising:

a base;

a vertical support column having an upper end and a lower end and being affixed to said base at the lower end;

a motor rotatably mounted at the upper end of the support column;

means to rotate the motor;

a sweep arm having a proximal end and a distal end and being in cooperation with said motor at the proximal end such that the sweep arm is oriented horizontally outward from said motor and is moved back and forth over the subject as the motor rotates;

at least one contact member depending from the distal end of the sweep arm, said contact member being composed of a semi-rigid material; and adjustment means integral with vertical support column to adjust the height of the vertical support column such that the contact member remains in contact with the subject when the sweep arm moves back and forth whereby when the motor rotates and the sweep arm rotates with it the contact member makes contact with the subject and moves back and forth across the subject inducing relaxation.

3. A relaxation inducing device of a type designed to be placed adjacent to a horizontal surface on which a subject lies prone, said device comprising:

a base;

a vertical support column having an upper end and a lower end and being affixed to said base at the lower end;

a motor rotatably mounted at the upper end of the support column;

means to rotate the motor;

a sweep arm having a proximal end and a distal end and being in cooperation with said motor at the proximal end such that the sweep arm is oriented horizontally outward from said motor and is moved back and forth over the subject as the motor rotates;

at least one contact member depending from the distal end of the sweep arm, said contact member being composed of a semi-rigid material;

adjustment means integral with said vertical support column to adjust the height of said vertical support column so that the contact member remains in contact with the subject when the sweep arm moves back and forth; and a timer to preset the desired time period during which the motor is to be rotated, whereby when the timer is set and the motor and sweep arm rotate, the contact member makes contact with the subject and moves back and forth across the subject inducing relaxation for the duration of the preset time period.

4. A relaxation inducing device of a type designed to be placed adjacent to a horizontal surface on which a subject lies prone, said device comprising:

a base;

a vertical support column having an upper end and a lower end and being affixed to said base at the lower end;

a motor rotatably mounted at the upper end of the support column;

means to rotate the motor;

a sweep arm having a proximal end and a distal end and being in cooperation with the motor at the proximal end such that the sweep arm is oriented horizontally outward from said motor and is moved back and forth over the subject as the motor rotates;

at least one contact member depending from the distal end of the sweep arm, said contact member being composed of a semi-rigid material;

adjustment means integral with said vertical support column to adjust the height of said vertical support column so that the contact member remains in contact with the subject when the sweep arm moves back and forth;

a timer to preset the desired time period for which the motor is to be rotated;

a housing rotatably mounted at the top of the support column for containment of the motor; and an aperture in said housing through which the sweep arm projects outwardly and horizontally;

whereby when the timer is set and the motor and sweep arm rotate, the contact member makes contact with the subject and moves back and forth across the subject inducing relaxation for the duration of the preset time period.

5. A relaxation inducing device of a type designed to be placed adjacent to a horizontal surface on which a subject lies prone, said device comprising:

a base;

a vertical support column having an upper end and a lower end and being affixed to said base at the lower end;

a motor rotatably mounted at the upper end of the support column;

means to rotate the motor;

a sweep arm having a proximal end and a distal end and being in cooperation with said motor at the proximal end such that the sweep arm is oriented horizontally outward from said motor and is moved back and forth over the subject as the motor rotates;

at least one first contact member removably attached to the distal end of the sweep arm and depending therefrom, said first contact member being composed of a semi-rigid material;

adjustment means integral with the vertical support column to adjust the height of said support column so that the first contact member remains in contact with the subject when the sweep arm moves back and forth; and at least one second contact member capable of being removably attached to the distal end of said sweep arm and depending therefrom, said second contact member being composed of a semi-rigid material and being capable of providing a sensation different from that of said first contact member when in contact with the subject;

whereby when the first contact member is removed and replaced with the second contact member a different sensation is created and when the motor and sweep arm rotate a contact member makes contact with the subject and moves back and forth across the subject thereby inducing relaxation.

6. A relaxation inducing device of a type designed to be used by a subject lying prone on a raised horizontal surface, said device comprising:

a base capable of placement substantially under the raised horizontal surface;

a vertical support column having an upper end and a lower end and being affixed at the lower end to an exposed portion of said base such that said support column is situated adjacent to the raised horizontal surface;

a motor rotatably mounted at the upper end of the support column;

means to rotate the motor;

a sweep arm having a proximal end and a distal end and being in cooperation with the motor at the proximal end such that the sweep arm is oriented horizontally outward from said motor and is moved back and forth over the subject as the motor rotates;

at least one first contact member removably attached to the distal end of the sweep arm and depending therefrom, said first contact member being composed of a semi-rigid material;

adjustment means integral with said vertical support column to adjust the height of the vertical support column so that the first contact member remains in contact with the subject when the sweep arm moves back and forth; and at least one second contact member capable of being removably attached to the distal end of said sweep arm and depending therefrom, said second contact member being composed of a semi-rigid material and being capable of providing a sensation different from said first contact member when in contact with the subject;

whereby the first contact member is removed and replaced with the second contact member a different sensation is created and when the motor is rotated and the sweep arm is rotated with the motor a contact member makes contact with the subject and moves back and forth across the subject thereby inducing relaxation.

* * * * *